US005894961A

United States Patent [19]

Kaufman et al.

[11] Patent Number: 5,894,961

[45] Date of Patent: Apr. 20, 1999

[54] DISPENSER WITH RESILIENT RESERVOIR STRUCTURE

[75] Inventors: John G. Kaufman, Burlington; Edmond L. Rampen, Oakville, both of Canada

[73] Assignee: Kaufman Products Inc., Oakville, Canada

[21] Appl. No.: 08/788,573

[22] Filed: Jan. 24, 1997

[51] Int. Cl.[6] ..... B65D 37/00

[52] U.S. Cl. ..... 222/212; 222/185.1; 222/207; 222/209; 222/478

[58] Field of Search ..... 222/185.1, 207, 222/209, 212, 457, 478, 479, 442, 464

[56] References Cited

U.S. PATENT DOCUMENTS

| | | | |
|---|---|---|---|
| 1,995,215 | 3/1935 | Mehlsen et al. . | |
| 2,680,010 | 6/1954 | Dubay | 261/124 |
| 3,422,993 | 1/1969 | Boehm et al. | 222/190 |
| 3,622,049 | 11/1971 | Thompson | 222/190 |
| 3,709,437 | 1/1973 | Wright | 239/343 |
| 3,985,271 | 10/1976 | Gardner | 222/190 |
| 4,018,364 | 4/1977 | Wright | 222/190 |
| 4,022,351 | 5/1977 | Wright | 222/145 |
| 4,147,306 | 4/1979 | Bennett | 239/327 |
| 4,184,615 | 1/1980 | Wright | 222/190 |
| 4,324,349 | 4/1982 | Kaufman | 222/207 |
| 4,429,834 | 2/1984 | Ito | 239/327 |
| 4,432,496 | 2/1984 | Ito | 239/327 |
| 4,635,828 | 1/1987 | Kaufman | 22/185 |
| 4,645,097 | 2/1987 | Kaufman | 222/207 |
| 4,957,218 | 9/1990 | Ford, Jr. | 222/1 |
| 5,033,653 | 7/1991 | Kaufman | 222/185 |
| 5,217,147 | 6/1993 | Kaufman | 222/185 |
| 5,427,279 | 6/1995 | Kaufman | 222/207 |
| 5,544,788 | 8/1996 | Meyer | 222/110 |

*Primary Examiner*—David J. Walczak
*Assistant Examiner*—Timothy L. Maust
*Attorney, Agent, or Firm*—Rogers & Scott

[57] ABSTRACT

A dispenser for liquid is provided having a relatively stiff or rigid container above a resiliently deformable reservoir structure. The container is coupled to the reservoir structure and the container has a bottom outlet inside the reservoir structure which also includes a discharge structure leading from the inside to the outside of the reservoir structure. Liquid is dispensed when the user causes relative movement between the container and the reservoir structure to increase the pressure in the reservoir structure and to thereby force liquid from the reservoir structure through the outlet passageway.

40 Claims, 5 Drawing Sheets

DISPENSER WITH RESILIENT RESERVOIR STRUCTURE

FIELD OF THE INVENTION

This invention relates to dispensers for liquids, the dispensers being operable manually to cause dispensing. More particularly the invention provides a dispenser having a stiff or rigid container coupled to a reservoir structure below the container and operable by causing relative motion between the container and the reservoir structure.

BACKGROUND OF THE INVENTION

Products in liquid form have for many years been packaged in a variety of containers suitable for shipping, displaying, handling and eventual sale. These containers have been made in a great variety of shapes and sizes with different types of closures. They include glass containers, and containers of synthetic plastics materials which have been molded and generally formed into shape. Also, because of the nature of these plastics materials, the closures can be of many various types including screw caps, flip tops, and simple bonded seals. The containers provide for releasing liquid either by opening a closure and pouring the contents or by a dispensing device such as a pump.

The present invention provides structures which take advantage of principles taught in U.S. patents Ser. Nos. 4,324,349; 4,635,828; 4,645,097; 5,033,653; and 5,427,279 to Kaufman all of which are examples of what have become known as "Kaufman dispensers". These patents teach dispensers which have no moving parts and yet satisfy the requirements of clean dispensing with temperature compensation to permit the dispenser to be subjected to a designed temperature range without significant inadvertent dripping or dispensing caused by temperature variations.

The structures shown in the Kaufman patents have a reservoir for liquid to be dispensed in communication with a main part of the dispenser in the form of a container where the major volume of the liquid is contained. Air is trapped above the liquid in the container under a negative pressure which prevents the liquid flowing from the container into the reservoir and out through a discharge passageway. Dispensing can be initiated in several ways. For instance embodiments are provided in the earlier patents which are caused to dispense by squeezing the container. The resiliently deformable container rebounds to its original shape when squeezing is discontinued so that air is sucked back into the passageway and the container is set up in a new condition of equilibrium.

U.S. Pat. No. 5,427,279 teaches embodiments which demonstrate dispensing by deforming the reservoir to cause dispensing. While the two approaches to actuating the dispenser appear similar in operation, the effects are different. When the container is squeezed, air in the container is compressed to allow liquid to flow from the container into the reservoir resulting in a pressure build up in the reservoir which drives liquid out through the discharge passageway. The action will vary as the volume of air in the container increases and the flow is controlled to some extent by liquid viscosity because the flow starts in the container and must pass into the reservoir before finding the discharge passageway. By contrast, when the dispenser is actuated by deforming the reservoir, pressure is built up in the reservoir directly resulting in flow of liquid from the reservoir through the discharge passageway. The latter approach gives a quicker response with less resistance to flow and the amount dispensed is more consistent no matter how much liquid remains in the container.

In all embodiments shown in the aforementioned patents, as the air is sucked back, liquid is essentially cleaned out from the discharge passageway and some of the air finds its way through the liquid to finish above the liquid in the container and some remains in the reservoir. It is the space in the reservoir above the liquid which effectively provides the temperature compensation. As temperature increases, the negative pressure above the liquid in the container becomes more positive resulting in some flow into the reservoir, and liquid will consequently rise in the reservoir and displace air out of the passageway. This action can continue within a range of calculated temperature compensation. Various structures are taught in the aforementioned patents to accommodate temperature compensation.

Deformable containers used to actuate dispensing must meet two conflicting criteria. Firstly the container must be sufficiently stiff to resist collapsing caused by the negative pressure built up inside the container above the liquid, and secondly, the container should be sufficiently supple to permit deformation by finger pressure to cause dispensing. It has been found that in some situations the user prefers to apply a load to the container using a full hand or elbow and it is therefore desirable to provide a dispenser which permits this action and yet separates the aforementioned conflicting criteria. Such a dispenser would require the use of a relatively stiff or rigid container to receive the load and transmit the load. It is among the objects of the present invention to provide such a dispenser which does not suffer from such conflicting criteria.

SUMMARY OF THE INVENTION

A dispenser for liquid is provided having a relatively stiff or rigid container above a resiliently deformable reservoir structure. The container is coupled to the reservoir structure and the container has a bottom outlet inside the reservoir which also includes a liquid discharge structure leading from the inside to the outside of the reservoir structure. Liquid is dispensed when the user causes relative movement between the container and the reservoir structure to increase the pressure in the reservoir structure and to thereby force liquid from the reservoir structure through the outlet passageway.

BRIEF DESCRIPTION OF THE DRAWINGS

The invention will be better understood with reference to the accompanying drawings, in which.

DESCRIPTION OF THE PREFERRED EMBODIMENTS

Figure 1:
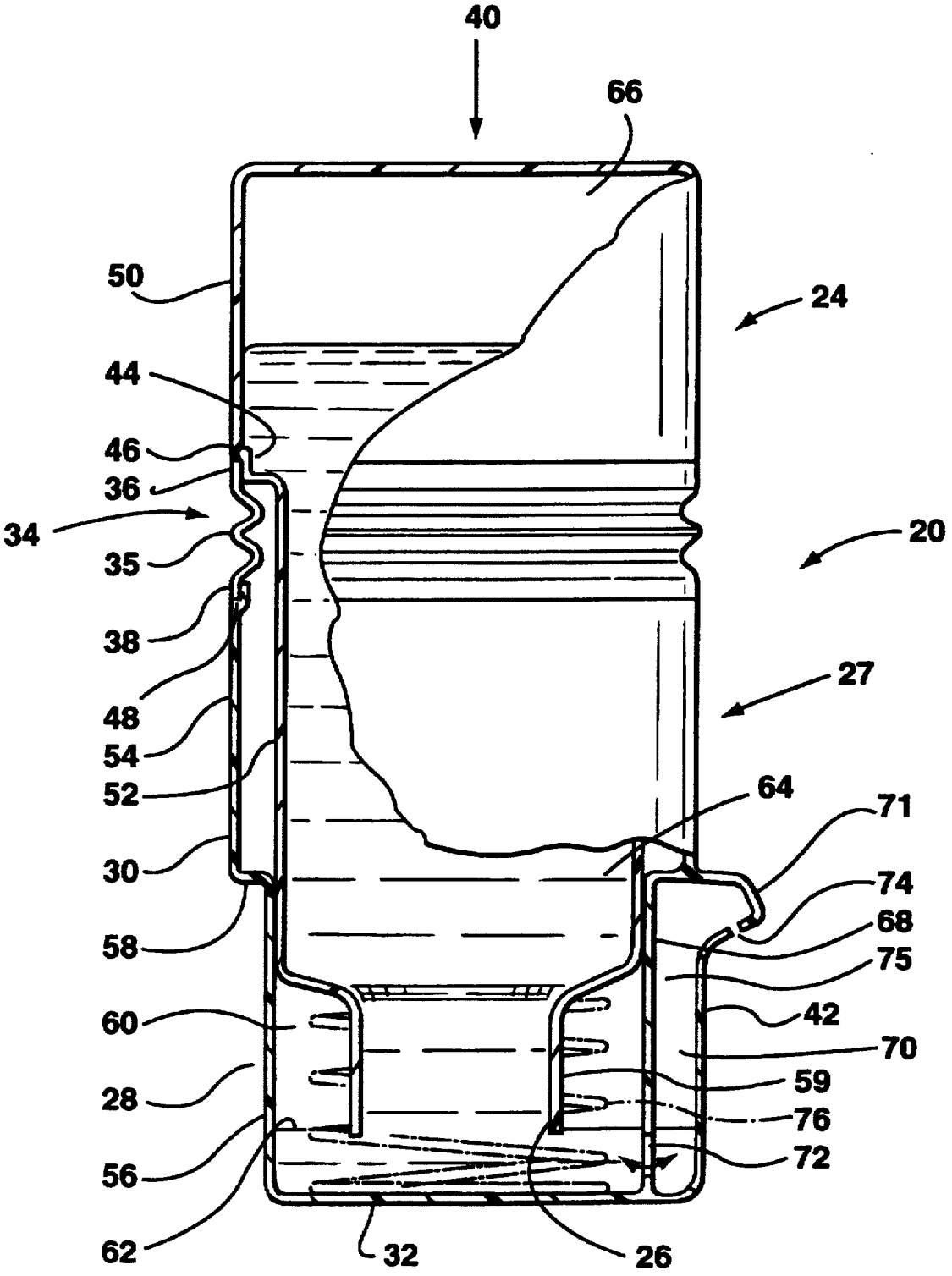
FIG. 1 is a side view with a major portion broken away to illustrate internal structure of a dispenser according to a first embodiment of the invention for dispensing liquid.

Reference is made firstly to FIG. 1 which illustrates an embodiment of the invention having the characteristics to be preferred in structures which are disposable and operated by applying a compressive load on the top of the dispenser. As seen in FIG. 1, the dispenser is designated generally by the numeral 20 and consists essentially of a container 24 having a bottom outlet 26 and a resiliently deformable reservoir structure 27. More specifically the reservoir structure 27 includes a reservoir 28 containing the bottom outlet 26 and having a peripheral wall 30 extending upwardly from a bottom wall 32, and a connection structure 34 having a resilient annular element 35 including respective top and bottom ends 36, 38 attached to the container 24 and to the reservoir 28 as will be described. This permits a downward force on the reservoir in the direction of the arrow 40 to cause relative motion between the container 24 and reservoir structure 27. As a result, the connection structure 34 is resiliently deformed resulting in discharge through a discharge structure 42 attached to the peripheral wall 30. This action will be described more fully later.

The container 24 is generally cylindrical and defines a peripheral step 44 extending inwardly and including a recess 46 to accommodate the top end 36 of the resilient annular element 35 which is maintained in position by bonding or adhesive as is common in the art. Similarly, the upper extremity of the peripheral wall 30 defines a recess 48 to receive the bottom end 38 of the annular element 35.

The resilient annular element 35 has a rounded bellows format to permit deflection as a result of the force in the direction of arrow 40 as will be described.

As a result of the step 44 in the container 24, the container has upper and lower sections 50, 52. Similarly, the reservoir peripheral wall is divided into upper and lower portions 54, 56, and the portions meet at a step 58. The lower portion 56 is also cylindrical and proportioned to slidingly receive the lower section 52 of the container 24 to permit free axial relative movement between these parts. Consequently when load is applied in the direction of the arrow 40, there will be relative movement between the container and the reservoir lower portion 56 in an axial or vertical direction (as drawn).

The container has a neck 59 extending downwardly from the lower section 52 and terminating at the bottom outlet 26. An air chamber 60 in reservoir 28 is defined by a liquid level 62, portions of the container 24, the reservoir 28, and the connection structure 34. The liquid level 62 results from liquid flowing from the container 24 into the reservoir 28 until the bottom outlet 26 is immersed in the liquid. This causes the air to be trapped and consequently the liquid reaches an equilibrium where negative pressure in an air space 66 above the liquid is balanced by the pressure head of liquid in the container.

The reservoir 28 is associated with the discharge structure 42 which includes an outlet passageway 70 defined by peripheral wall 30, an interior wall 68 and outlet structure 71. The passageway 70 extends upwardly from an inlet opening 72 below the level 62 of liquid, and terminates at a discharge opening 74 outside the dispenser and (in this case) above the liquid level 62.

It is important to note that the air chamber 60 is not an air lock. A very small hole 75 (in the order of 0.2 mm) is provided in the interior wall 68 adjacent the top of the air chamber. This hole permits air flow when the liquid level 62 changes as a result of ambient temperature changes. Consequently the pressure in the air chamber remains at substantially atmospheric pressure.

The container 24 and reservoir 28 can be relatively stiff or rigid although some flexibility would be acceptable. The dispenser is actuated by causing relative motion between the container 24 and the reservoir structure 27, (and more particularly between the container 24 and the reservoir 28) in the direction of the arrow 40. This movement results in the resilient annular element 35 being deformed to disrupt the equilibrium of the liquid and air in the dispenser. Clearly, the element 35 has to be of a material with sufficient rigidity to support the container 24 and its contents in the position shown and then exhibit sufficient resilience to allow the user to apply a load in the direction of the arrow 40 to dislodge the container 24 downwardly. Although it is preferable that the dispenser can be actuated without the need for a very large force, the arrangement permits the element 35 to be resistant to deformation because the user can apply a whole hand on the container to apply a downward force.

As the container is moved downwardly, the volume of air in the air chamber 60 is reduced resulting in an increase in pressure which drives liquid at the level 62 downwardly and thereby causes dispensing of liquid upwardly through the outlet passageway 70 and eventually through the discharge opening 74. At the same time a very small volume of air will escape through the air hole 75. This volume is insignificant and is not noticed by the user.

Once the user removes the load from the dispenser, the resilient annular element 35 will lift the container 24 upwardly thereby causing negative pressure in the air chamber 60 to draw air back into the dispenser. Clearly, because some liquid has been dispensed, the pool of liquid in the reservoir must be replenished and this is done naturally by liquid falling from the container through the bottom outlet 26 to reestablish equilibrium with a larger volume of air in the space 66 above the liquid.

The dispensing action can be repeated until all of the liquid has fallen out of the container leaving a pool in the bottom of the reservoir. This pool can be dispensed by tilting the dispenser to cause the liquid to flow towards the discharge opening 74, and then, when a load is applied to move the container 24 towards the reservoir 28, the change in pressure in the air chamber 60 will cause dispensing. Consequently, it is possible to remove substantially all of the liquid.

A further feature of the dispenser is the fact that the liquid in the container 24 is naturally falling gradually and leaves the walls of the container clean. Consequently, there is limited waste.

The dispenser can be made from any suitable materials and this would include synthetic plastics materials but it is envisaged that because the container can be rigid, it could be made from glass. Various elastomeric materials can be used for the resilient element 35, with or without reinforcement such as spring steel inserts, and the selection of these well known materials would depend upon the loading requirements and the characteristics of the dispenser.

As mentioned earlier, the resilient annular element 35 forms part of the structure defining the air chamber 60. Inherently the element performs both the function of resiliently supporting the container 24, but also the element exhibits an air seal to avoid leakage from the air chamber 60. These two characteristics can be separated or shared.

As seen in FIG. 1, an optional coiled compression spring 76 (shown in ghost outline) extends about the neck 59 of the container 24 and rests against the bottom wall of the reservoir 28. This spring can be of any suitable materials (including synthetic plastics materials) and the selection of the spring will dictate the "feel" of the dispenser in use. For instance, on the one hand the spring could be prestressed only sufficiently to assist the element 35, and on the other hand the spring could absorb all of the support and resilient deformation while the element 35 acts only to seal the air chamber 60. Variations in the relationships between spring 76 and element 35 are possible within the scope and utility of the invention.

Figure 2:
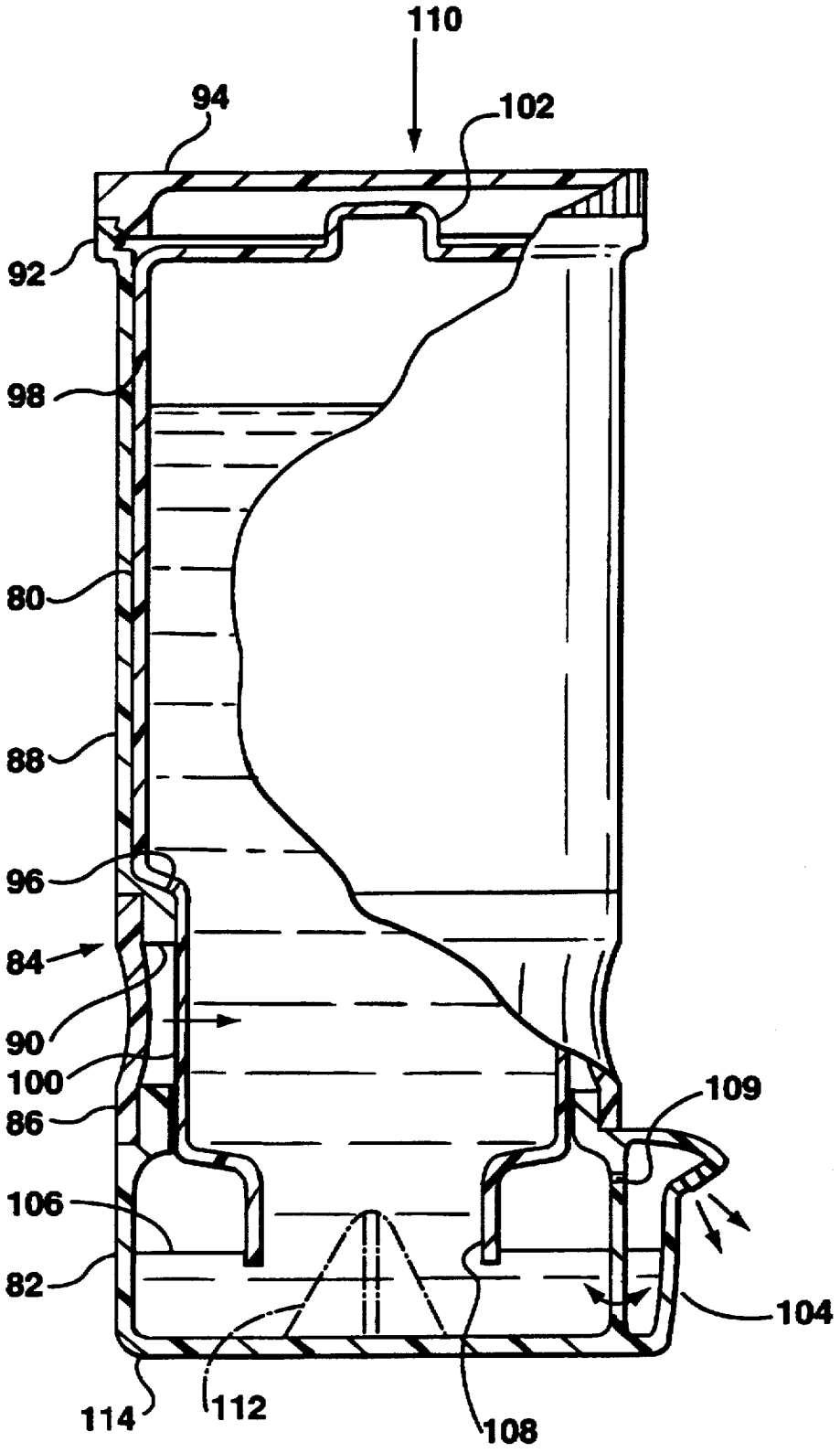
FIG. 2 is a view similar to FIG. 1 and illustrating an alternative embodiment of the invention which permits the use of a replaceable container.

Reference is next made to FIG. 2 which illustrates an embodiment to be preferred when a replaceable container filled with liquid is to be used in the dispenser. In this embodiment, a container 80 is provided which is a sliding fit in a reservoir 82 somewhat in the fashion described with reference to FIG. 1. However, in this instance, a connection structure 84 is provided having a resilient annular element 86 connected to the reservoir and to an upwardly extending sleeve 88 having a lower end 90 attached to the element 86 and an upper end 92 including a threaded connection to a cap 94. The sleeve is formed with an internal shoulder 96 proportioned to accommodate a complementary step in the container where an upper section 98 of the container meets a lower section 100. Consequently, the container 80 is located within the sleeve 88 and, because of the connection of the sleeve to the reservoir 82, it is located in relation to the reservoir.

The container 80 also includes an upward projection 102 at the top of the container for gripping the container to pull it out of the sleeve after it has been emptied.

A discharge structure 104 is provided similar to that shown in FIG. 1 and liquid finds a level 106 about a bottom outlet 108 of the container 80. The structure includes an air hole 109 providing pressure equalization during temperature fluctuations.

The embodiment shown in FIG. 2 is operated in similar fashion to that described with reference to FIG. 1. However, in this case the resilient annular element 86 is in the form of an inwardly offset ring which will tend to move inwardly when the annular load is applied in the direction of the arrow 110. This inward deflection will tend to reduce the volume of air above the level 106 and thereby complement the downward action of the container to cause dispensing through the discharge structure 104.

FIG. 2 also shows in ghost outline a tooth structure 112 attached to a bottom wall 114 of the reservoir 82. This structure is proportioned to normally project inside the bottom outlet 108 and is designed to penetrate a diaphragm seal (not shown) over the outlet 108. As a result, because the container can be removed and replaced, it is possible to drop a new container full of liquid into the sleeve and when the container meets the tooth structure 112, a diaphragm over the bottom outlet 108 will be severed thereby allowing the liquid to fall into the reservoir 82. This is convenient for replaceable cartridges which could be used in a permanent structure having a decorative outward appearance to enhance the acceptability of the dispenser as a housewares product.

One of the characteristics of the structure shown in FIG. 2 is that the container 80 is not subjected to any loading in use other than that caused by negative pressure within the container. Consequently, provided the container is made to withstand the pressure loading, it will be acceptable. When the dispenser is actuated, all of the loading applied in the direction of the arrow 110 is carried by the cap 94, and sleeve 88 and applied to the resilient element 86 which of course is supported by the reservoir 82.

As with the structure shown in FIG. 1, there will be guidance between the reservoir and the container to maintain alignment of the sleeve and the reservoir. Clearly, the proportions of the container and reservoir must be chosen to permit this sliding action.

It may be preferable to provide a dispenser which can be actuated by moving the container in a direction other than axially as shown in FIGS. 1 and 2. For instance, in dispensers which are supported on a wall, it may be preferable if the user can move the dispenser in any direction to cause dispensing. In such circumstances the embodiment shown in FIG. 3 may be preferred.

Figure 3:
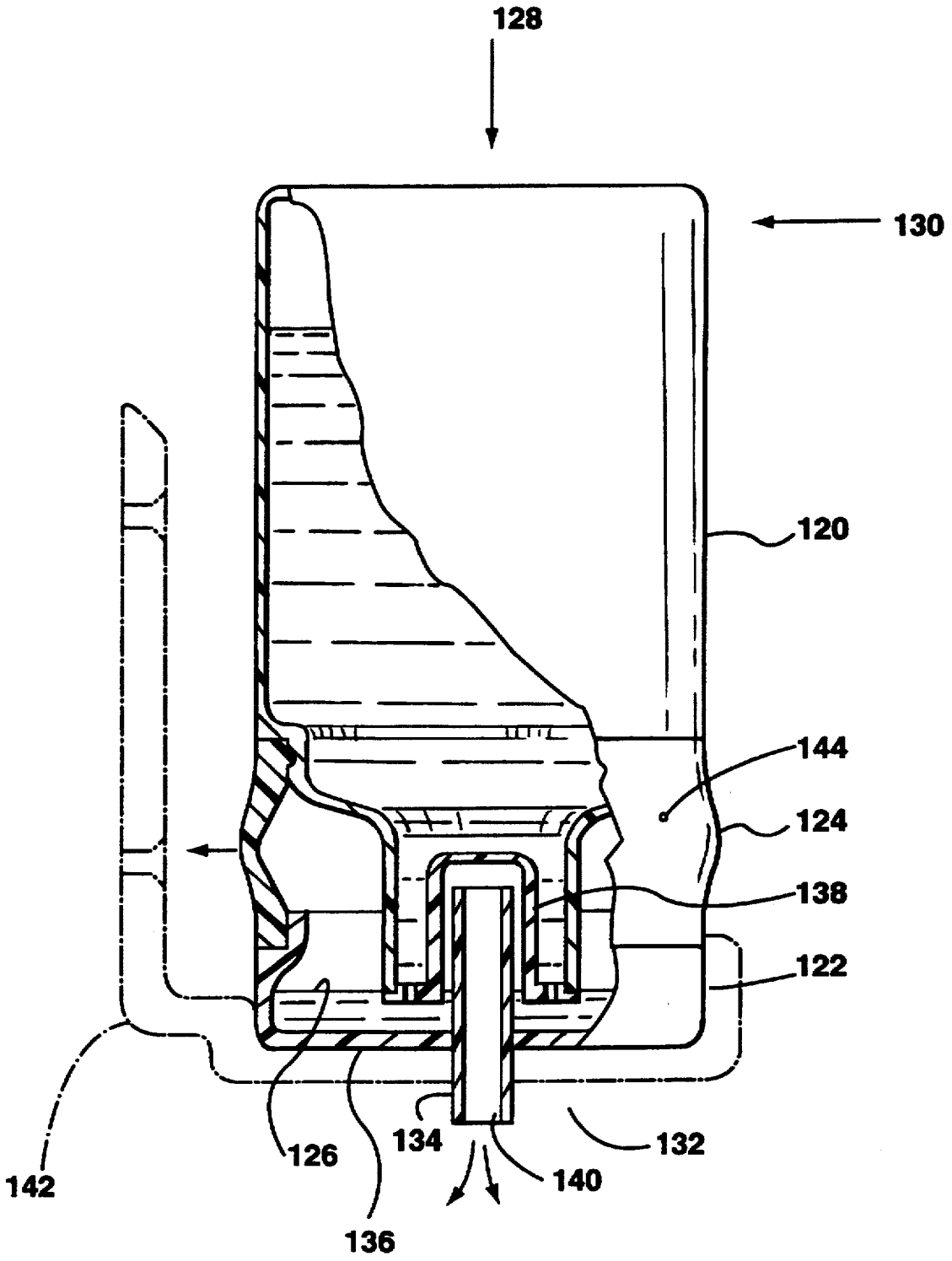
FIG. 3 is a further view similar to FIG. 1 and illustrating another embodiment of the invention having characteristics suitable for use as a wall mounted dispenser.

As seen in FIG. 3, a relatively stiff or rigid container 120 is coupled to a reservoir 122 by an outwardly bulging resilient annular element 124. There is no guidance between the container and the reservoir and consequently the container can be pushed downwardly or sideways in order to deform the element 124 and cause a reduction in volume of the air above a liquid level 126 in the reservoir. Also, because the annual element is bulging outwardly, there will be some increase in the volume as the bulging increases. There has to be a balance between the reduction caused by tilting and resulting downward movement of the container 120 (caused by action in the direction of the arrows 128, 130) and the increase caused by the bulging to ensure that liquid will be discharged through a discharge structure designated generally by the numeral 132 and attached to a bottom wall 136.

In this case, the discharge structure includes a tube 134 mounted in the bottom wall 136 of the reservoir and extending upwardly above the liquid level 126. When dispensing takes place, liquid will be caused to move upwardly within a bell shaped cover 138 attached to the neck of the container. The liquid will move upwardly until it reaches an upper extremity of the tube 134 and then the liquid will travel downward through the tube and out via a discharge opening 140. The tube 134 and cover 138 must be proportioned to allow relative motion between the container and the reservoir as the user tilts the container.

An air hole 144 is provided in the element 124 to permit pressure equalization. Clearly, such holes can be placed in a dispenser wherever pressure equalization can take place without affecting the performance of the dispenser.

As also seen in FIG. 3, the dispenser can be supported in a wall bracket 142 shown in ghost outline.

The embodiments described with reference to FIGS. 1 to 3 include the use of a connection structure having a resilient annular element. The connection structure is part of the reservoir structure indicated in FIG. 1 by the numeral 27. In FIGS. 1 to 3 the reservoir structure incorporates a resilient element which is deformed to cause dispensing. Outlet passageways are attached either to the container or to the reservoir forming part of the reservoir structure. The invention can be embodied in dispensers where the outlet structure is part of the resilient element. Exemplary structures will now be described with reference to FIGS. 4 and 5.

Figure 4:
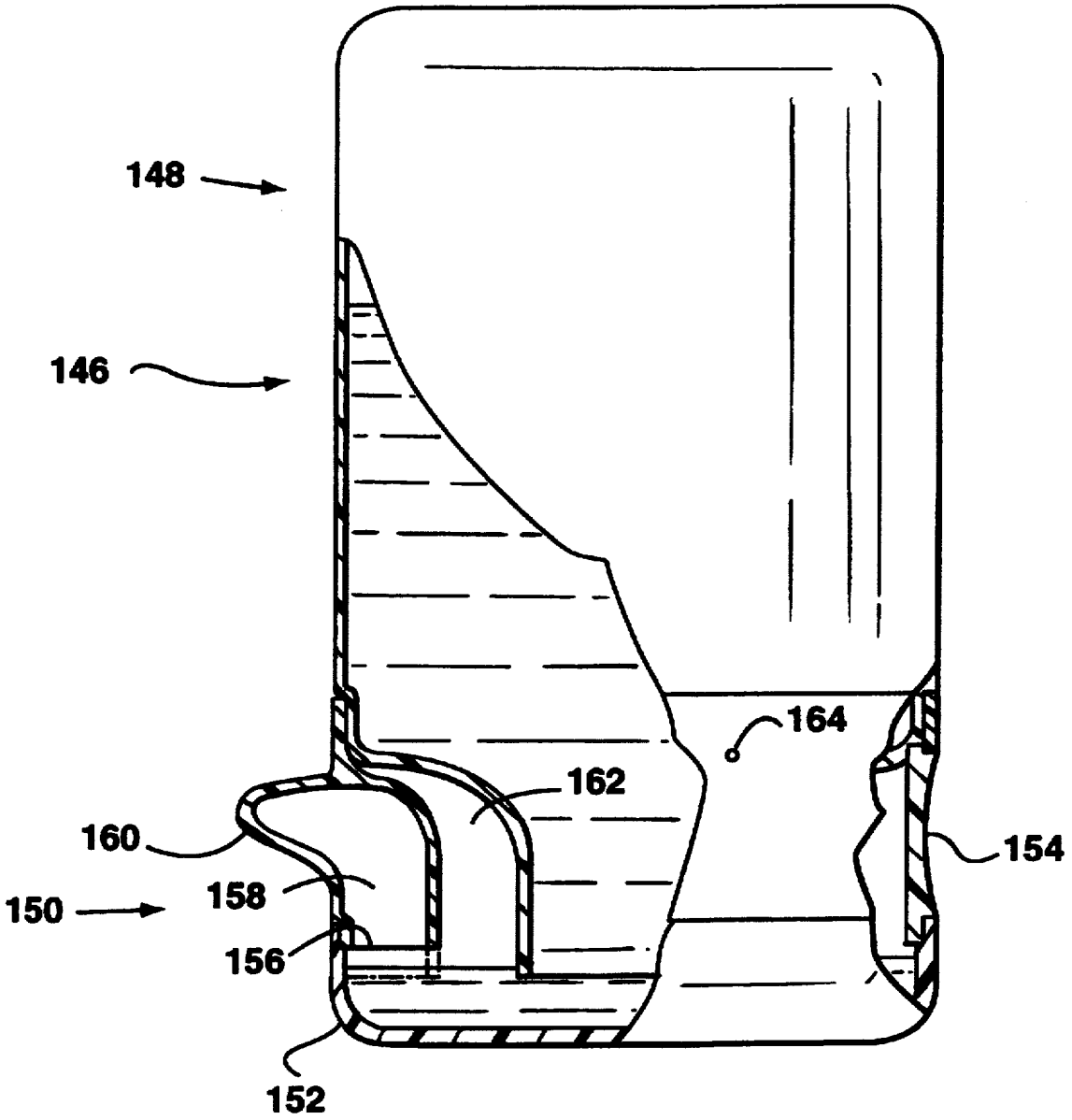
FIGS. 4 and 5 are views similar to FIG. 1 and illustrating other embodiments of the invention.

As seen in FIG. 4, a dispenser indicated generally by the numeral 146 includes a container 148 connected to a reservoir structure 150. In this case, the reservoir structure consists of a shallow reservoir 152 which is connected to a compound resilient element 154 which in turn is connected to the container 148. The element 154 is generally annular in shape and includes an inlet opening 156 at the bottom of an outlet passageway 158 leading upwardly to a discharge opening 160. As a result, when the user causes the container 148 and reservoir 152 to move towards one another, air in a chamber 162 will become compressed as liquid moves upwardly in the reservoir to seal off the inlet opening 156. Once there is compression in the air chamber 162, liquid will flow through the outlet passageway 158 and exit through the discharge opening 160.

In the embodiment shown in FIG. 4, the liquid level in the reservoir is free to rise until it meets the inlet opening 156. Consequently, there is significant temperature compensation before this point is reached. In order to expand the volume available for temperature compensation, an air hole 164 may be provided. Clearly, this air hole is necessary only if there is insufficient temperature compensation provided between the level of the liquid in the reservoir and the inlet opening 156.

FIG. 4 also shows in ghost outline that the inlet opening 156 could be lower than that shown in full outline. In this case temperature compensation will depend upon the provision of the air hole 164.

Figure 5:
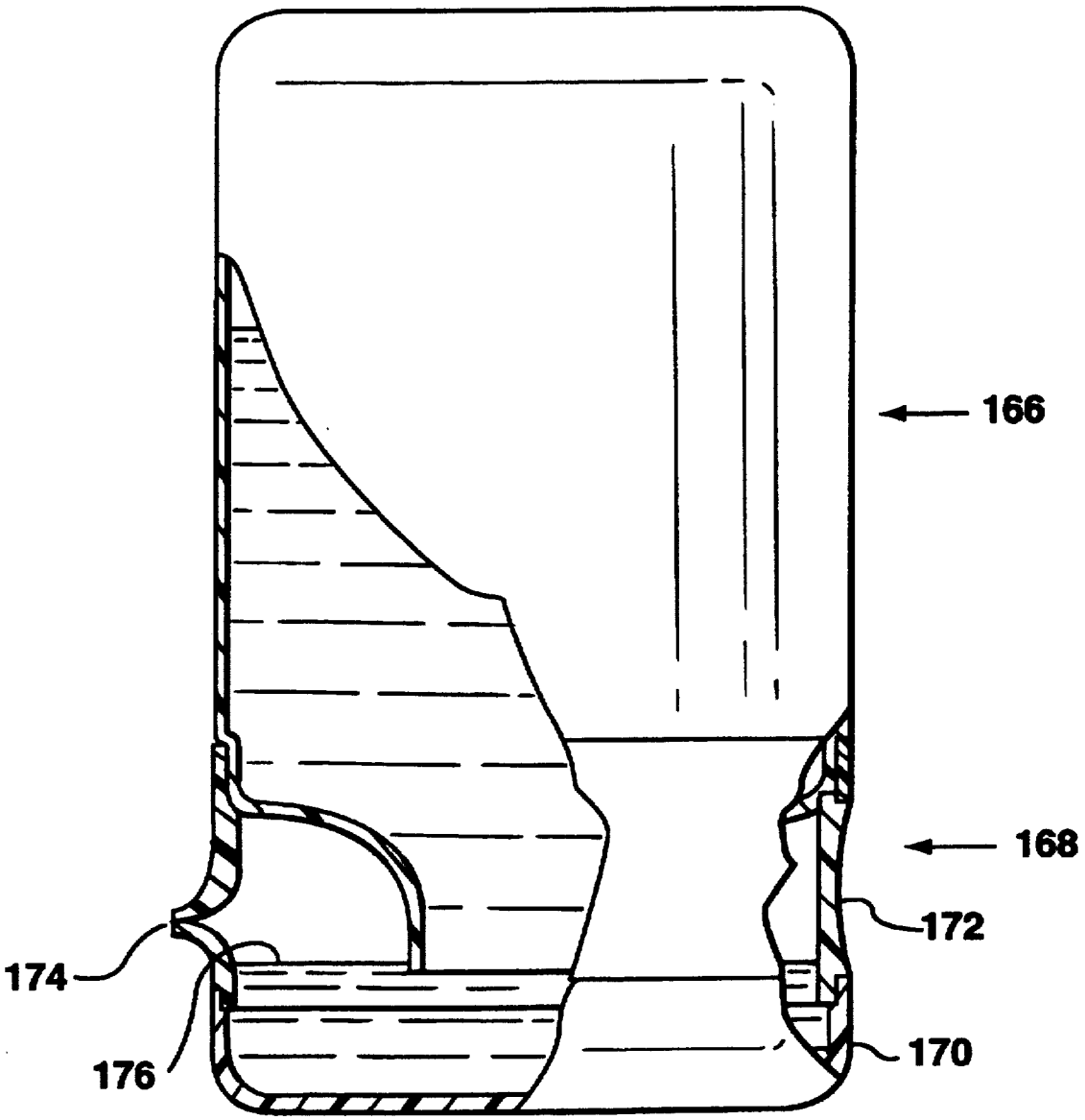

A further embodiment which may be of use in special circumstances is shown in FIG. 5. In this embodiment a container 166 is coupled to a reservoir structure 168 having a reservoir 170 and a resilient annular element 172. This element defines a discharge opening 174 in the form of a resilient slit structure which will open larger when internal pressure is applied. The structure is designed to permit limited inward motion of air and will open larger when dispensing. Consequently, there is a temperature compensation provided by volume between a level 176 of liquid and the discharge opening 174. This level of course can be varied by design. If the difference in levels is too large, then the response time will be increased because the user must move the container 166 downwardly sufficiently to create pressure to move the level of liquid 176 up to the discharge opening 174. After discharge, sufficient air will flow inwardly to replace the lost liquid.

The structure shown in FIG. 5 will have somewhat different characteristics from that of the previous embodiments and in particular, there will be a threshold pressure designed into the discharge outlet 174 so that until this pressure is met, significant discharge will not take place.

It will be appreciated that the embodiments shown in this description are typical of numerous forms of the invention which can be designed incorporating the invention. All such forms are within the scope of the invention as described and claimed.

We claim:

1. A dispenser for liquids having:

a container for the liquid, the container including a bottom outlet;

a reservoir below the container and containing the bottom outlet and having a bottom wall and a peripheral wall extending upwardly from the bottom wall;

connection structure coupled to the container and to the reservoir to form a sub-assembly, and including a resilient annular element, the connection structure maintaining the relative positions of the container and the reservoir with the container above the reservoir so that liquid in the container will flow into the reservoir until equilibrium is established with the liquid in the reservoir reaching a liquid level in the reservoir, and the bottom opening being immersed in the liquid;

a discharge structure coupled to the sub-assembly and defining a discharge opening;

an air chamber contained above said liquid level in the reservoir and defined at least in part by the resilient annular element; and the dispenser being actuated by causing relative movement between the container and the reservoir to deform the resilient element whereby air pressure is increased rapidly in the air chamber to cause liquid to flow through the outlet passageway and out of the dispenser, and upon release, the dispenser will draw air inwardly through the outlet passageway to clean the passageway and replace discharged liquid thereby permitting equilibrium to be reestablished in the dispenser.

2. A dispenser as claimed in claim 1 in which the connection structure further includes a compression spring positioned in the reservoir and in contact with the container to bias the container away from the reservoir.

3. A dispenser as claimed in claim 2 in which the resilient annular element extends upwardly from the peripheral wall of the reservoir.

4. A dispenser as claimed in claim 3 in which the discharge structure further includes a tube projecting through said bottom wall and extending from above said liquid level and terminating at said discharge opening.

5. A dispenser as claimed in claim 3 in which the connection structure further includes a sleeve having upper and lower ends, the lower end being attached to the resilient annular element and the sleeve extending upwardly from the lower end and supporting the container so that the container and the sleeve move together when the user actuates the dispenser.

6. A dispenser as claimed in claim 5 in which the connection structure further includes a cap releasably connected to the sleeve at said upper end to trap the container in the sleeve and to permit replacement of the container in the sleeve.

7. A dispenser as claimed in claim 1 in which the resilient annular element extends upwardly from the peripheral wall of the reservoir.

8. A dispenser as claimed in claim 7 in which the connection structure further includes a sleeve having upper and lower ends, the lower end being attached to the resilient annular element and the sleeve extending upwardly from the lower end and supporting the container so that the container and the sleeve move together when the user actuates the dispenser.

9. A dispenser as claimed in claim 8 in which the connection structure further includes a cap releasably connected to the sleeve at said upper end to trap the container in the sleeve and to permit replacement of the container in the sleeve.

10. A dispenser as claimed in claim 1 in which the discharge structure further includes an outlet passageway having an inlet positioned to be below said level, the passageway extending upwardly initially from said inlet and terminating outside the reservoir at said discharge opening.

11. A dispenser as claimed in claim 10 in which the discharge opening is above said liquid level.

12. A dispenser as claimed in claim 11 in which the discharge structure is attached to said peripheral wall.

13. A dispenser as claimed in claim 1 in which the air chamber defines a temperature compensation air hole providing communication between the air chamber and atmosphere so that as temperature fluctuations cause the liquid level to change slowly, the pressure in the air chamber will be maintained at substantially atmospheric pressure.

14. A dispenser for liquids having:

a container for the liquid, the container including a bottom outlet;

a reservoir below the container and containing the bottom outlet and having a bottom wall and a peripheral wall extending upwardly from the bottom wall;

a resilient annular element having top and bottom ends, the top end being attached to the container and the bottom end being attached to the reservoir to position the container above the reservoir with the bottom outlet in the reservoir so that liquid in the container will flow into the reservoir and establish an equilibrium with the bottom opening immersed in the liquid, and the liquid being at a liquid level in the reservoir;

and an air chamber contained above the liquid level and defined at least in part by the resilient annular element;

a temperature compensation air hole providing communication between the air chamber and atmosphere so that as temperature fluctuations cause the liquid level to change slowly, the pressure in the air chamber will be maintained at substantially atmospheric pressure; and a discharge structure coupled to the reservoir and defining an outlet passageway having an inlet positioned to be below said liquid level, and a discharge opening, the passageway extending upwardly from said inlet and terminating outside the reservoir at said discharge opening whereby a user can dispense the liquid by applying a load to deform the annular element thereby disturbing said equilibrium and causing increased air pressure in the air chamber so that liquid will flow through the outlet passageway and out of the dispenser, and upon release, the dispenser will draw air inwardly through the outlet passageway to clean the passageway and replace discharged liquid thereby permitting equilibrium to be reestablished in the dispenser.

15. A dispenser as claimed in claim 14 in which the discharge structure further includes a tube projecting through said bottom wall and extending from above said liquid level and terminating at said discharge opening.

16. A dispenser as claimed in claim 14 in which the discharge opening is above said liquid level.

17. A dispenser as claimed in claim 14 in which the discharge structure is attached to said peripheral wall.

18. A dispenser for liquids having:

a container for the liquid, the container including a bottom outlet;

a reservoir below the container and containing the bottom outlet and having a bottom wall and a peripheral wall extending upwardly from the bottom wall;

a sleeve about the container and supporting the container, the sleeve extending upwardly from a lower end to an upper end;

a resilient annular element having top and bottom ends, the top end being attached to the reservoir and the bottom end being attached to the lower end of the sleeve to position the container above the reservoir with the bottom outlet in the reservoir so that liquid in the container will flow into the reservoir and establish an equilibrium with the bottom opening being immersed in the liquid and the liquid being at a liquid level in the reservoir;

an air chamber contained in the reservoir above the liquid level;

a temperature compensation air hole providing communication between the air chamber and atmosphere so that as temperature fluctuations cause the liquid level to change slowly, the pressure in the air chamber will be maintained at substantially atmospheric pressure; and a discharge structure coupled to the reservoir and defining an outlet passageway having an inlet positioned to be below said liquid level, and a discharge opening, the passageway extending upwardly from said inlet and terminating outside the reservoir at said discharge opening whereby a user can dispense the liquid by applying a load to deform the annular element thereby disturbing said equilibrium and causing increased air pressure in the air chamber so that liquid will flow through the outlet passageway and out of the dispenser, and upon release, the dispenser will draw air inwardly through the outlet passageway to clean the passageway and replace discharged liquid thereby permitting equilibrium to be reestablished in the dispenser.

19. A dispenser as claimed in claim 18 in which the connection structure further includes a cap releasably connected to the sleeve at said upper end to trap the container in the sleeve and to permit replacement of the container.

20. A dispenser as claimed in claim 18 in which the discharge structure further includes a tube projecting through said bottom wall and extending from above said liquid level and terminating at said discharge opening.

21. A dispenser as claimed in claim 18 in which the discharge opening is above said liquid level.

22. A dispenser as claimed in claim 21 in which the discharge structure is attached to said peripheral wall.

23. In a dispenser for liquids having a container for the liquid, the container including a bottom outlet, and a reservoir below the container, the reservoir containing the bottom outlet and having a bottom wall and a peripheral wall extending upwardly from the bottom wall, and a discharge structure coupled to the reservoir and defining an outlet passageway having an inlet and a discharge opening, the passageway extending upwardly from said inlet and terminating outside the reservoir at said discharge opening, the bottom outlet being in the reservoir so that liquid in the container will flow into the reservoir and establish equilibrium with the liquid at a liquid level in the reservoir, the bottom opening and the inlet of the discharge structure being immersed in the liquid in the reservoir, and an air chamber contained in the reservoir above the liquid level, the improvement in which the dispenser further includes a resilient connection structure coupling the container to the reservoir for maintaining the relative positions of the container and the reservoir with the container above the reservoir, the resilient connection structure including an annular element defining at least part of the air chamber, whereby a user can dispense the liquid by applying a load to deform the connection structure thereby disturbing said equilibrium and causing increased air pressure in the air chamber so that liquid will flow through the outlet passageway and out of the dispenser, and upon release, the dispenser will draw air inwardly through the outlet passageway to clean the passageway and replace discharged liquid thereby permitting equilibrium to be reestablished in the dispenser.

24. In a dispenser as claimed in claim 23 the further improvement in which the connection structure includes a sleeve supporting the container, the sleeve having upper and lower ends, the lower end being attached to the annular element and the sleeve extending upwardly from the lower end and extending about the container so that the container and sleeve more together when the user actuates the dispenser.

25. In a dispenser as claimed in claim 23 the further improvement in which the connection structure includes a cap releasably connected to the sleeve at said upper end to trap the container in the sleeve and to permit replacement of the container.

26. A dispenser for liquids operable by applying a downward load on the dispenser, the dispenser having:

an upright relatively stiff container for the liquid, the container having a bottom outlet and a top for receiving said downward load;

a reservoir containing the bottom outlet to receive liquid from the container in a pool about the bottom outlet;

a resilient connection structure coupled to the container and to the reservoir;

an air chamber in the reservoir defined at least in part by the connection structure and having an air hole communicating with atmosphere to maintain atmospheric pressure in the air chamber during ambient temperature fluctuations;

a discharge structure extending from the reservoir to outside the dispenser for carrying the liquid from the reservoir to outside the dispenser; and the dispenser operating in response to said downward load which resiliently deflects the connection structure thereby reducing the volume of the air chamber to force liquid through the discharge structure to dispense the liquid.

27. A dispenser for liquids, the dispenser having:

a container including a bottom outlet;

a reservoir below the container and containing the bottom outlet, the reservoir normally containing liquid and the liquid defining a liquid level above the bottom outlet;

a connection structure coupling the container to the reservoir for supporting the container above the reservoir, the connection structure being resiliently deformable to permit a user to move the container and reservoir towards one another;

an air chamber defined at least in part by the connection structure and contained above the liquid level; and a discharge structure attached to the reservoir and having a outlet passageway including an inlet inside the reservoir and below the liquid level and a discharge opening, the passageway extending upwardly from the inlet whereby a user can cause dispensing by causing relative movement to reduce the volume of the air chamber so that a resulting increase in pressure in the air chamber will cause liquid to flow out through the outlet passageway.

28. A dispenser as claimed in claim 27 in which the air chamber defines a small air hole communicating the air chamber with atmosphere to provide equalization of pressure in the chamber with atmospheric pressure.

29. A dispenser for liquids having:

a container for the liquid, the container including a bottom outlet;

a reservoir below the container and containing the bottom outlet and having a bottom wall and a peripheral wall extending upwardly from the bottom wall;

connection structure coupled to the container and to the reservoir to form a sub-assembly, the connection structure including a resilient element maintaining the relative positions of the container and the reservoir with the container above the reservoir so that liquid in the container will flow into the reservoir until equilibrium is established with the liquid in the reservoir reaching a liquid level in the reservoir, and the bottom opening being immersed in the liquid;

a discharge structure coupled to the sub-assembly and defining an outlet passageway having an inlet positioned to be below said liquid level, and a discharge opening, the passageway extending upwardly initially from said inlet and terminating outside the reservoir at said discharge opening;

an air chamber contained above said liquid level in the reservoir, the air chamber being defined at least in part by the connection structure; and the dispenser being actuated by causing relative movement between the container and the reservoir to deform the resilient element whereby air pressure is increased rapidly in the air chamber to cause liquid to flow through the outlet passageway and out of the dispenser, and upon release, the dispenser will draw air inwardly through the outlet passageway to clean the passageway and replace discharged liquid thereby permitting equilibrium to be reestablished in the dispenser.

30. A dispenser as claimed in claim 29 in which the resilient element is positioned in the reservoir and in contact with the container to bias the container away from the reservoir, and in which the connection structure further includes a sleeve having upper and lower ends, the lower end being attached to the resilient element and the sleeve extending upwardly from the lower end and supporting the container so that the container will move with the sleeve when the user actuates the dispenser.

31. A dispenser as claimed in claim 30 in which the connection structure further includes a cap releasably connected to the sleeve at said upper end to trap the container in the sleeve and to permit replacement of the container.

32. A dispenser as claimed in claim 29 in which the air chamber defines a temperature compensation air hole providing communication between the air chamber and atmosphere so that as temperature fluctuations cause the liquid level to change slowly, the pressure in the air chamber will be maintained at substantially atmospheric pressure.

33. A dispenser for liquids having:

a container for the liquid, the container including a bottom outlet;

a reservoir below the container and containing the bottom outlet and having a bottom wall and a peripheral wall extending upwardly from the bottom wall;

a resilient annular element having top and bottom ends, the top end being attached to the container and the bottom end being attached to the reservoir to position the container above the reservoir with the bottom outlet in the reservoir so that liquid in the container will flow into the reservoir and establish an equilibrium with the bottom opening immersed in the liquid, and the liquid being at a liquid level in the reservoir;

and an air chamber contained above the liquid level and defined at least in part by the resilient annular element, a temperature compensation air hole providing communication between the air chamber and atmosphere so that as temperature fluctuations cause the liquid level to change slowly, the pressure in the air chamber will be maintained at substantially atmospheric pressure; and a discharge structure coupled to the resilient annular element and defining a discharge opening whereby a user can dispense the liquid by applying a load to deform the annular element thereby disturbing said equilibrium and causing increased air pressure in the air chamber so that liquid will flow through the discharge opening and out of the dispenser, and upon release, the dispenser will draw air inwardly through the discharge opening to replace discharged liquid thereby permitting equilibrium to be reestablished in the dispenser.

34. A dispenser as claimed in claim 33 in which the discharge structure further includes an outlet passageway having an inlet positioned to receive liquid from the liquid in the reservoir, and extending upwardly from the inlet and terminating at said discharge opening.

35. A dispenser as claimed in claim 34 in which the inlet enters the liquid in the reservoir when the user deforms the annular element.

36. A dispenser as claimed in claim 34 in which the inlet is positioned to be normally in the liquid in the reservoir.

37. A dispenser for liquids operable by applying a downward load on the dispenser, the dispenser having:

an upright relatively stiff container for the liquid, the container having a bottom outlet and a top for receiving said downward load;

a resiliently deformable reservoir structure coupled to the container and containing the bottom outlet to receive liquid from the container in a pool about the bottom outlet;

an air chamber in the reservoir structure having an air hole communicating with atmosphere to maintain atmospheric pressure in the air chamber during ambient temperature fluctuations;

a discharge structure coupled to the reservoir structure and extending from the reservoir structure to outside the dispenser for carrying the liquid from said pool to outside the dispenser; and the dispenser operating in response to said downward load which resiliently deflects the reservoir structure thereby reducing the volume of the air chamber to force liquid through the discharge structure to dispense the liquid.

38. A dispenser as claimed in claim 37 in which the inlet of the outlet passageway is normally adjacent to and above said liquid level.

39. A dispenser as claimed in claim 37 in which the inlet of the outlet passageway is normally below said liquid level and in which the air chamber includes a small air hole connecting the air chamber with atmosphere to maintain atmospheric pressure in the air chamber.

40. A dispenser for liquids, the dispenser having:

a container including a bottom outlet;

a reservoir below the container and containing the outlet, the reservoir normally containing liquid and the liquid defining a liquid level above the bottom outlet;

a connection structure coupling the container to the reservoir for supporting the container above the reservoir, the connection structure being resiliently deformable to permit a user to move the container and reservoir towards one another;

an air chamber contained above the liquid level and defined at least in part by the connection structure; and a discharge structure attached to the connection structure and having an outlet passageway including an inlet inside the reservoir and a discharge opening, the passageway extending upwardly from the inlet whereby a user can cause dispensing by creating relative movement between the container and the reservoir to reduce the volume of the air chamber so that a resulting increase in pressure in the air chamber will cause liquid to flow out through the outlet passageway.

* * * * *